US006397480B1

(12) United States Patent
Mak et al.

(10) Patent No.: US 6,397,480 B1
(45) Date of Patent: Jun. 4, 2002

(54) MECHANISM FOR SHARPENING A WRITING INSTRUMENT

(75) Inventors: King Biu Mak; Chung Yin Ronald Mak; Chung Ming Mak, all of Kowloon (HK)

(73) Assignee: Mosel Vitelic Inc., Hsinchu (TW)

( * ) Notice: Subject to any disclaimer, the term of this patent is extended or adjusted under 35 U.S.C. 154(b) by 0 days.

(21) Appl. No.: 09/611,323

(22) Filed: Jul. 6, 2000

(51) Int. Cl.[7] ..... B43L 23/06
(52) U.S. Cl. ..... 30/457; 30/458; 30/461
(58) Field of Search ..... 30/451, 457, 458, 30/459, 461

(56) References Cited

U.S. PATENT DOCUMENTS 4,506,716 A * 3/1985 Hayashi ..... 145/3.5
4,620,370 A * 11/1986 Zownir et al. ..... 30/494
4,755,074 A * 7/1988 Roberts ..... 30/460

* cited by examiner

*Primary Examiner*—M. Rachuba
(74) *Attorney, Agent, or Firm*—Burns, Doane, Swecker & Mathis, L.L.P.

(57) ABSTRACT

A pencil sharpener (10) is disclosed as including a body (12) with a hole (22) for receiving an end of a pencil, a cutting blade (24) secured to the body (12) for sharpening the pencil, and a stopper (30) movable relative to the body (12) to vary the length of the end of the pencil which may be received into the hole (22).

6 Claims, 3 Drawing Sheets

MECHANISM FOR SHARPENING A WRITING INSTRUMENT

BACKGROUND OF THE INVENTION

This invention relates to a mechanism for sharpening a writing instrument, e.g. pencil, and in particular such a sharpening mechanism in which the length of the sharpened end of the writing instrument which may be inserted into the sharpening mechanism may be adjusted.

Pencil sharpeners have been made available for a very long period of time. While various modifications have been made to the outward appearance of such sharpeners to make them more aesthetically attractive, relatively few improvements have been made to the basic structure. Conventional pencil sharpeners include a generally conical insertion hole tapering from a broad outer entrance to a sharp inner end. This hole allows an end of a pencil to be inserted into the sharper, such that the pencil will be sharpened by a cutting blade secured to the sharpener when the pencil is rotated relative to, and moves into, the sharpener.

In one type of conventional pencil sharpeners, the inner end of the hole is not closed, such that the pencil may be caused to go on rotating relative to and moving into the insertion hole. The disadvantage of such an arrangement is that more than the necessary pencil may be cut away, or the user may not wish the pencil to be so sharp.

As an improvement, some pencil sharpeners are provided with a stopper at the inner end of the insertion hole so as to limit the inward movement of the pencil relative to the sharpener. By way of such an arrangement, once the pencil has proceeded to abut the stopper, further rotation thereof will not bring about any further inward movement of the pencil, so that no further pencil will be cut away. A disadvantage associated with such an arrangement is that the pencil sharpener cannot sharpen the pencil to a degree of sharpness which is up to the requirement of the user.

As yet a further improvement, some conventional sharpeners provide two insertion holes, each with a cutting blade, yet one without a stopper and one with a stopper. Not only does such an arrangement increase the cost of production, this type of pencil sharpeners also suffers from the shortcoming that basically only two degrees of sharpness are allowed.

It is thus an object of the present invention to provide an improved mechanism for sharpening an writing instrument in which the above shortcomings are mitigated, or at least to provide a useful alternative to the public.

SUMMARY OF THE INVENTION

According to the present invention, there is provided a mechanism for sharpening a writing instrument, which mechanism including a body member with a hole adapted to receive an end of said writing instrument, a cutting blade secured to said mechanism and adapted to sharpen said writing instrument, wherein said mechanism further includes a stopper movable relative to said body member to vary the length of said end of said writing instrument receivable into said hole.

BRIEF DESCRIPTION OF THE DRAWINGS

An embodiment of the present invention will now be described, by way of an example, and with reference to the accompanying drawings, in which.

DETAILED DESCRIPTION OF THE PREFERRED EMBODIMENT

Figure 1:
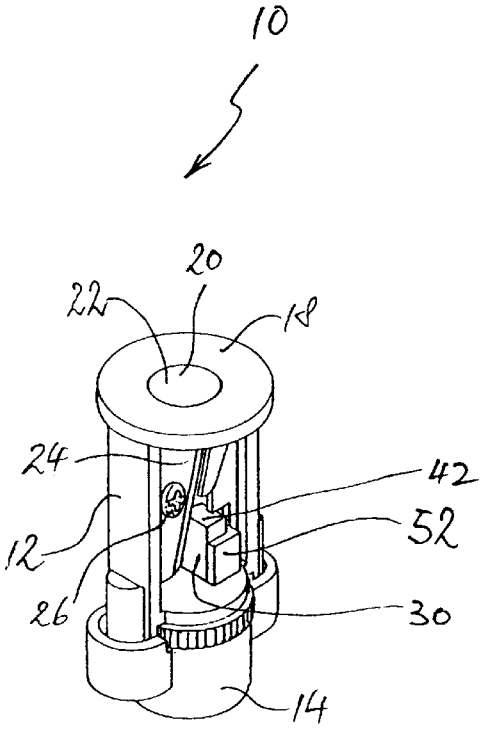
FIG. 1 is a perspective view of a pencil sharpener according to the present invention.
Figure 2:
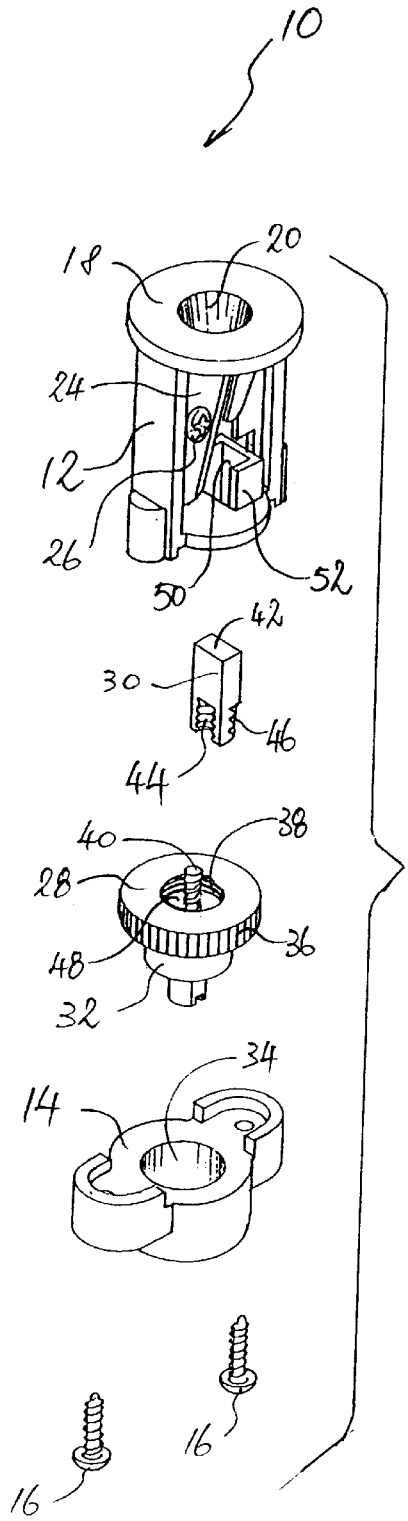
FIG. 2 is an exploded view of the pencil sharpener shown in FIG. 1.
Figure 8:
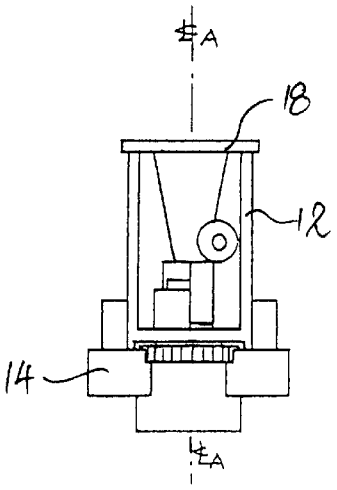
FIG. 8 is a rear view of the pencil sharpener shown in FIG. 4.
Figure 7:
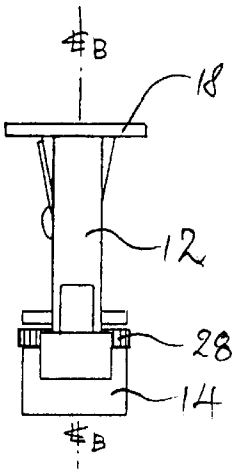
FIG. 7 is a right side view of the pencil sharpener shown in FIG. 4.
Figure 4:
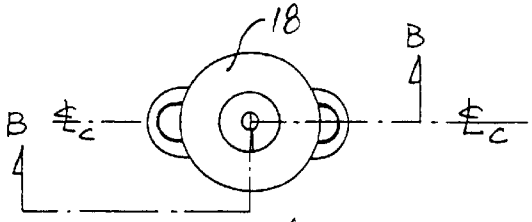
FIG. 4 is a top view of the pencil sharpener shown in FIG. 1.
Figure 3:
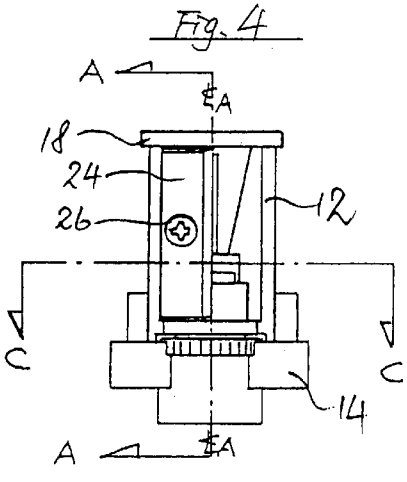
FIG. 3 is a front view of the pencil sharpener shown in FIG. 1.
Figure 5:
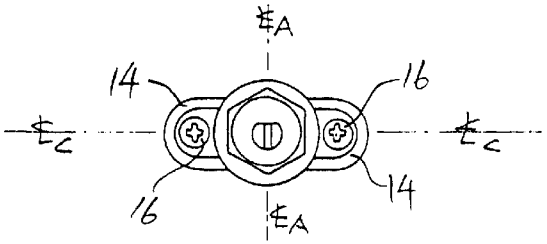
FIG. 5 is a bottom view of the pencil sharpener shown in FIG. 4.
Figure 6:
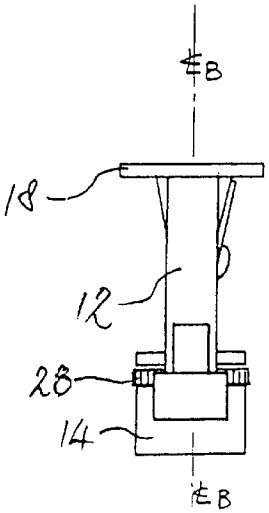
FIG. 6 is a left side view of the pencil sharpener shown in FIG. 4.
Figure 11:
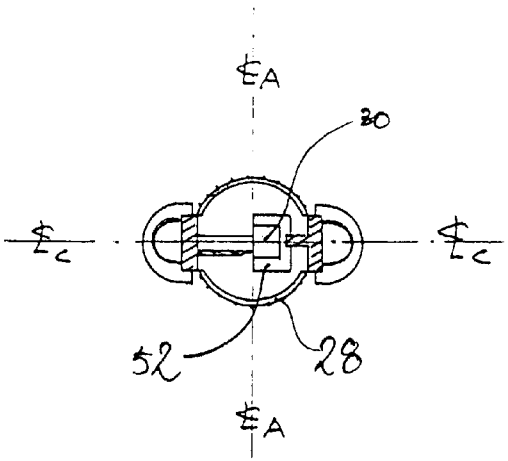
FIG. 11 is a cross-sectional view of the pencil sharpener taken along the line C—C in FIG. 3.
Figure 10:
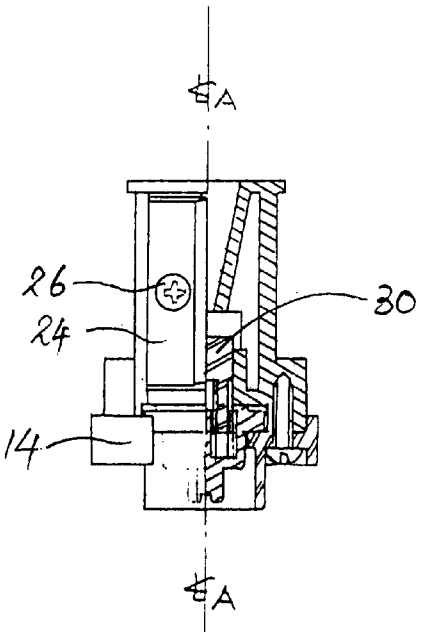
FIG. 10 is a cross-sectional view of the pencil sharpener taken along the line B—B in FIG. 4.
Figure 9:
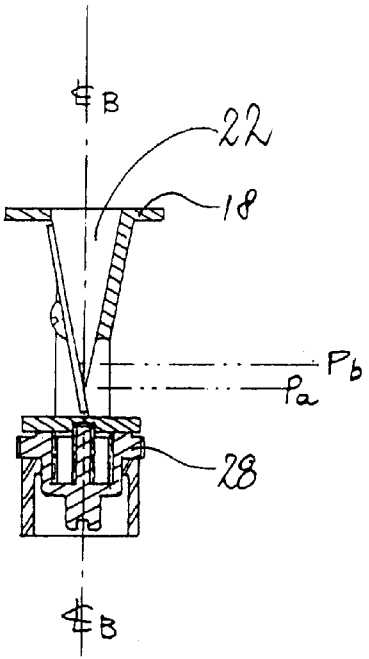
FIG. 9 is a cross-sectional view of the pencil sharpener taken along the line A—A in FIG. 3.

FIGS. 1 and 2 show a pencil sharpener according to the present invention, generally designated as 10. The pencil sharpener 10 includes a body 12 which is secured to an end cap 14 by two screws 16. The body 12 includes a front circular plate 18 with a circular entrance 20, which leads into a conical hole 22, which may be seen more clearly in FIG. 9. As in conventional pencil sharpeners, a cutting blade 24 is secured by a screw 26 to the body 12, so that when an end of a pencil is inserted into the hole 22, rotation and moving in of the pencil relative to the body 12 will cause the pencil to be cut and sharpened by the blade 24.

As can be seen clearly in particular in FIG. 2, the pencil sharpener 10 includes a knob 28 associated with a stopper 30. A lower end 32 of the knob 28 is received with a cavity 34 of the end cap 14, and a ring 36 sits on the end cap 14, so that the knob 28 may rotate relative to the end cap 14. The inner surface 38 of the ring 36 is threaded. In addition, the knob 28 includes a spindle 40 whose outer surface is threaded. The stopper 30 includes a stopping surface 42. The lower part of the stopper 30 is provided with internal threads 44 and external threads 46. The lower part of stopper 30 is received within a cavity 48 between the spindle 40 of the knob 28, and the inner surface 38 of the ring 36 of the knob 28, in such a way that the internal threads 44 of the stopper 30 mesh with the spindle 40, and the external threads 46 mesh with the threads on the inner surface 38 of the ring 36. It should be understood that although there are the two threaded engagements between the knob 28 and the stopping member 30, i.e. the engagement between the spindle 40 and the internal threads 44 of the stopper 30 on the one hand, and the engagement between the external threads 46 of the stopper 30 and the threads in the inner surface 38 of the ring 36 on the other hand, one such engagement will suffice for the purpose of the present invention.

The upper part of the stopper 30 is in the form of a generally rectangular prism, and is received within a channel 50 formed by a guiding member 52, which guides the movement of the stopper 30 relative to the body 12. By way of such an arrangement, rotation of the knob 28 will cause the stopper 30 to translationally move relative to the body 12 between a first position (as indicated by $P_a$ in FIG. 9) in which the stopping surface 42 is at or lower than (in the sense of FIG. 9) the sharp end of the hole 22, and a second position (as indicated by $P_b$ in FIG. 9) which is above (again in the sense of FIG. 9) the end of the hole 22. When the stopping surface 42 is in position $P_a$, the pencil sharpener 10 will function as one with no stopper. When the stopper 30 is moved by the knob 28 such that the stopping surface 42 is at $P_b$, the end of the pencil inserted into the hole 22 will abut the stopping surface 42, so as to limit the length of the end of the pencil which can be inserted into the hole 22. Such an arrangement may thus vary the length of the end of a pencil which can be inserted into the hole 22. A further feature of the present invention is that the stopping surface 42 may be positioned anywhere between $P_a$ and $P_b$, so that the degree of sharpness of the sharpened pencil may be selected by the user.

What is claimed is:

1. A mechanism for sharpening a writing instrument comprising a body member with a hole adapted to receive an end of said writing instrument, a cutting blade secured to said mechanism and adapted to sharpen said writing instrument, and a knob member and a stopper threadedly engaged with each other, wherein said knob member is movable only rotationally relative to said body member about a longitudinal axis of said body member, and wherein rotation of said knob member causes said stopper to slidingly move along an axis which is substantially parallel to said longitudinal axis of said body member to vary the length of the end of a writing instrument receivable into said hole.

2. A mechanism according to claim 1 wherein said knob member and said stopper are movable relative to each other.

3. A mechanism according to claim 1 wherein said stopper includes an end with an outer threaded portion which is engaged with a threaded portion in at least part of an inner surface of said knob member.

4. A mechanism according to claim 1 wherein said stopper includes an end with an inner threaded portion which is engaged with a threaded portion in at least part of a spindle member of said knob member.

5. A mechanism according to claim 1 wherein said stopper includes a substantially rectangular prismatic end translationally movable relative to a guiding member.

6. A pencil sharpener including a mechanism according to claim 1.

* * * * *

UNITED STATES PATENT AND TRADEMARK OFFICE

CERTIFICATE OF CORRECTION

PATENT NO. : 6,397,480 B1
DATED : June 4, 2002
INVENTOR(S) : Chung Ming Mak et al.

It is certified that error appears in the above-identified patent and that said Letters Patent is hereby corrected as shown below:

Title page,
Delete any reference to the Assignee as this application is not assigned.

Signed and Sealed this

Fifteenth Day of October, 2002

*Attest:*

*Attesting Officer*

JAMES E. ROGAN
*Director of the United States Patent and Trademark Office*